United States Patent [19]

Polic

[11] Patent Number: 4,541,828

[45] Date of Patent: Sep. 17, 1985

[54] TOOL SUPPORT WITH AN ARRANGEMENT FOR CENTERING AND FIXING A TOOL THEREIN

[75] Inventor: Georg Polic, Prilly, Switzerland

[73] Assignee: Bobst S.A., Lausanne, Switzerland

[21] Appl. No.: 596,660

[22] Filed: Apr. 4, 1984

[30] Foreign Application Priority Data

Apr. 22, 1983 [CH] Switzerland ..... 2171/83

[51] Int. Cl.[4] ..... B31B 3/14; B31B 1/25; B31B 1/20

[52] U.S. Cl. ..... 493/468; 493/473; 493/475; 493/61; 83/698

[58] Field of Search ..... 493/468, 473, 474, 475, 493/476, 477, 478, 479, 61; 83/698; 269/111; 407/70

[56] References Cited

U.S. PATENT DOCUMENTS

| | | | |
|---|---|---|---|
| 2,183,400 | 12/1939 | Herrmann | 493/473 |
| 2,456,240 | 12/1948 | Aver | 493/475 |
| 3,063,349 | 11/1962 | Phillips et al. | 493/473 |
| 4,295,641 | 10/1981 | Bolcher | 269/136 |

FOREIGN PATENT DOCUMENTS

| | | | |
|---|---|---|---|
| 127955 | 4/1950 | Sweden | 269/111 |

*Primary Examiner*—Francis S. Husar
*Assistant Examiner*—William E. Terrell
*Attorney, Agent, or Firm*—Hill, Van Santen, Steadman & Simpson

[57] ABSTRACT

A tool support having an arrangement for centering and fixing a tool and a rectangular frame characterized by a pair of pressing members mounted on adjacent sides of the frame and an arrangement to urge the pressing members away from their adjacent frame members so that a tool is moved diagonally toward an opposite corner of the frame. Preferably, one of the pressing members has a slanted plane end surface forming a cam surface which is engaged by a roller mounted on the other pressing member so that movement of the other pressing member is transferred to the one pressing member. The mounting arrangement also includes a tightening arrangement to bias the pressing members away from the adjacent side members of the frame.

4 Claims, 11 Drawing Figures

TOOL SUPPORT WITH AN ARRANGEMENT FOR CENTERING AND FIXING A TOOL THEREIN

BACKGROUND OF THE INVENTION

The present invention is directed to a device for centering and fixing a tool within a support or holder, for example, for locating and fastening a cutting form in a frame-type holder.

In order to cut and crease in one single operation a complete cardboard sheet from manufacturing folded box blanks, the tool used in the cardboard cutting press is made of a rectangular plate which is usually wooden and which has various cutting blades and creasing rules inserted into the plate. This type of tool is generally called a cutting form.

The mounting of a cutting form in the cutting station of a press requires its centering and fixing into a metal frame. There are several methods to achieve the centering and fixing operation for a cutting form into its frame. One can start with the tightening of the cutting form against one of the smaller inner faces of the frame. The tightening is then achieved with a plurality of screws which are positioned along sides of the frame. Of course, the first tightening should not be too strong so that during the second tightening operation on an adjacent side, the cutting form can slightly shift until it touches the inner surface of the other or opposite side of the frame. The centering of the cutting form is thus achieved in two distinctive operations. Moreover, the material used for these cutting forms, which material is usually wood, will deform under the action of the tightening of the screws. To avoid this, one generally uses a dynamometric key or tool for the tightening of the screws which are tightened in a given succession so that the pressure is equally distributed on the whole periphery of the cutting form. This cutting form must be centered with accuracy in the frame so that it can be precisely registered with the coacting cutting and creasing counterparts which face it from another member of the cutting station. The tightening of the cutting form can also be achieved with well known metal tightening wedges or other tightening means. But it is to be noted first that it is difficult with the described system to obtain a pressure which is regularly distributed on the whole periphery of the cutting form and secondly that the measurement of the cutting form suffers from size or shape modifications during this cutting job. The variations are particularly due to hydroscopic conditions, to the raising of the temperature during the processing and to the compression of the wood under the effects of the cutting and tightening pressures.

Consequently, the solution described hereinabove requires a careful control of the tightening and centering of the cutting form and thus a certain amount of time for these operations. Nevertheless, a danger of deforming the frame remains high as the tightening screws tend to apply a bending force on each side of the frame like a beam with several loads placed at several points therealong. No automatic adjustment of the clearance occurs between the cutting form and the frame can be achieved to compensate for size variation of the cutting form. The screws and the tightening wedges will remain as positioned and the form will be able to move in the frame. The consequence of this movement is the lack of accuracy in the registration of the cutting form and its counterpart.

SUMMARY OF THE INVENTION

The present invention is directed to eliminate these drawbacks by providing a device which allows an accurate centering and a fast tightening of the cutting form within its frame without important deformation of the frame or the cutting form. In addition, the device will automatically compensate for changes in the size of the cutting form during a cutting operation.

To accomplish these goals, the present invention is directed to a tool support with an arrangement for centering and fixing a tool in the tool support, said tool support having a rectangular frame having a pair of longitudinal side members connected to a pair of transverse side members; a pair of pressing members; first means mounting one of the pair of pressing members for movement on one of the side members of the frame and second means mounting the other of the pair of pressing members for movement on a second side member adjacent the one side member, each of the pressing members being a bendable blade having a pressing surface curved along the length of the member with a profile matching a profile of a beam resting on two supports and bearing a uniformly distributed load, the one pressing member having an end with an inclined plane to form a cam surface, the other pressing member having an end provided with a roller engaging said cam surface, said first means mounting the one pressing member having the cam surface including a central axle in the one pressing member, a guide member on the one side member having a slot extending perpendicular to the one side member, slidably receiving the axle, and a tightening means adjacent an end opposite the cam surface for biasing the end away from the one side member, the second means mounting the other pressing member having a roller adjacent one end including a central axle on the other member, a guide member on the second side member having a slot extending transverse to the second side member slidably receiving the central axle, and a pair of tightening means for biasing the other pressing member away from the second side member so that actuation of the tightening means adjacent the roller causes both pressing members to exert a diagonally directed force on a tool to urge it in a diagonal direction from the corner adjacent the roller and further actuation of the remaining tightening means urges both pressing members into full engagement with the tool in the centered position.

Preferably, each of the pressing members is provided with a support plate adjacent one side of the pressing surface to support the tool during the centering and fixing process. Each of the tightening means may be a hydraulic tightening means, a pneumatic tightening means, or a mechanical tightening means. The mechanical tightening means includes a guide pin having a head telescopically receiving a spring arrangement and being telescopically received by a threaded member which is threaded into the side member. The guide pin preferably has the head acting on a ball received in a bore in the pressing member. The hydraulic and pneumatic tightening means can utilize a piston in a cylinder for acting on the guide pin either directly or through a resilient element such as the spring arrangement.

BRIEF DESCRIPTIOIN OF THE DRAWINGS

DESCRIPTION OF THE PREFERRED EMBODIMENTS

Figure 1:
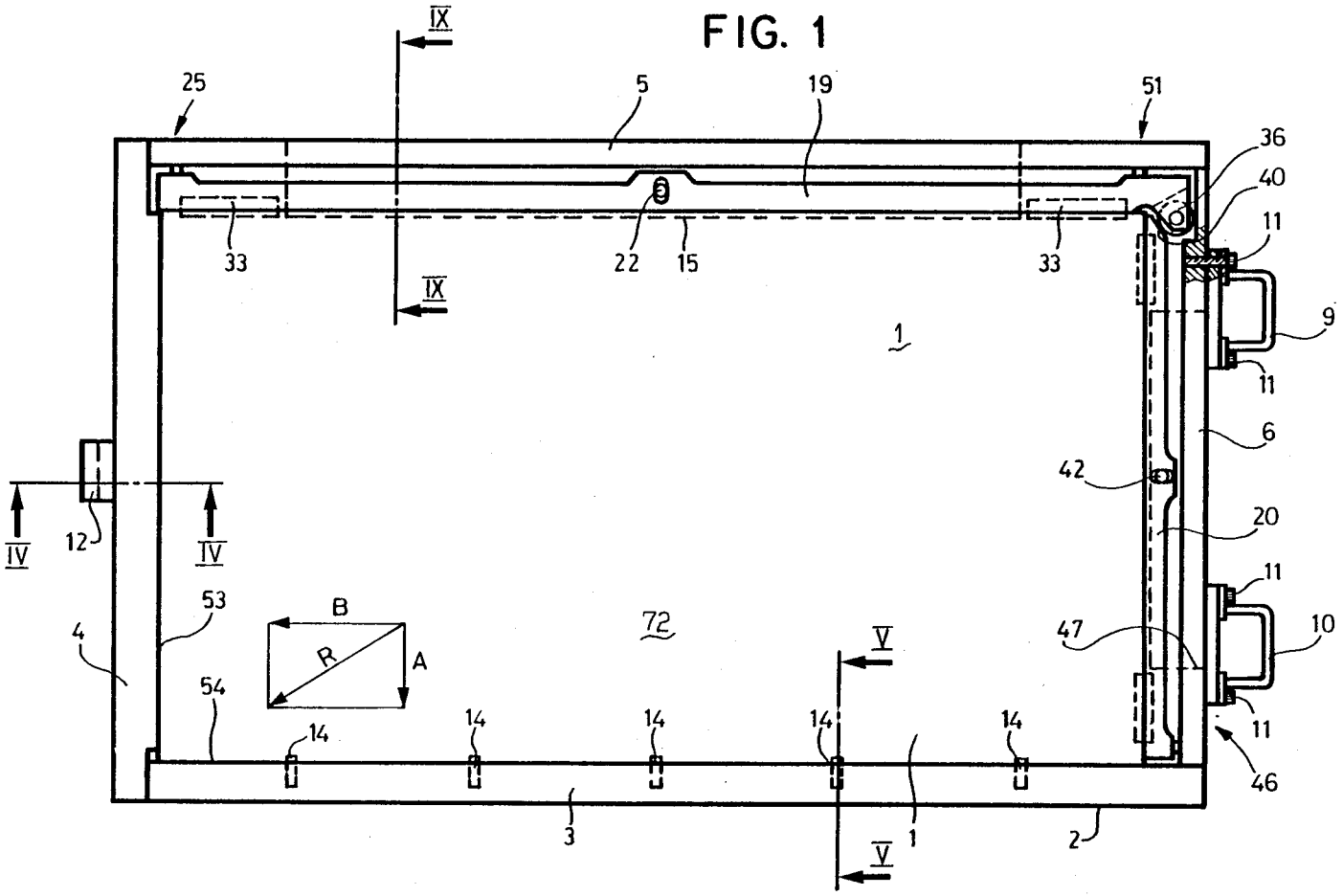
FIG. 1 is a plan view with portions removed for purposes of illustration taken from beneath a frame supporting a cutting form in accordance with the present invention.

The present invention of a tool support is particularly useful when it has a rectangular frame 2 of FIG. 1 for supporting a cutting form 1. As illustrated, the cutting form is a wooden member or board which can have a plurality of cutting blades and/or creasing blades or rules such as 70 (FIG. 7) embedded in the board to extend from one surface 71 which is opposite a surface 72. As illustrated in FIG. 1, the form 1 is mounted in a frame with the surface 72 which does not have the cutting blades or creasing rules facing the observer.

Figure 5:
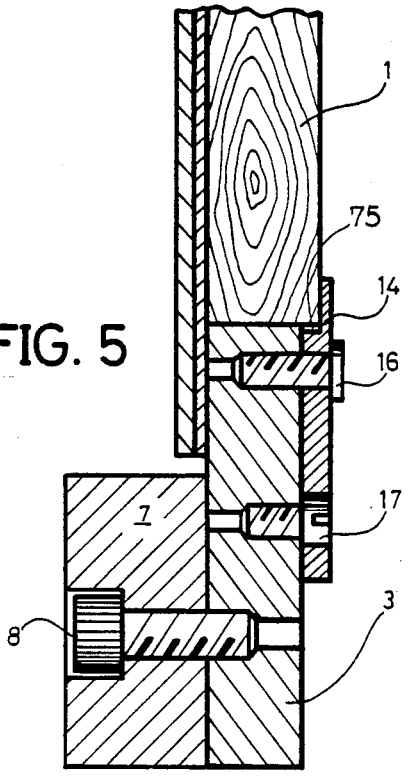
FIG. 5 is a cross-sectional view with portions in elevation for purposes of illustration taken along lines V—V of FIG. 1.
Figure 7:
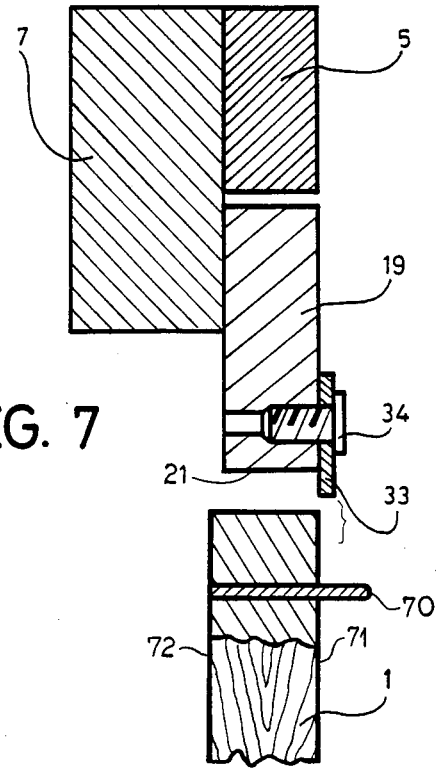
FIG. 7 is a cross-sectional view with portions in elevation for purposes of illustration taken along lines VII—VII of FIG. 2.
Figure 8:
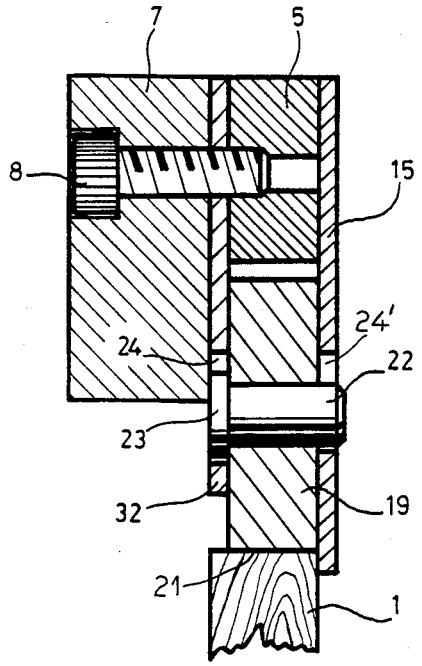
FIG. 8 is a cross-sectional view with portions in elevation for purposes of illustration taken along lines VIII—VIII of FIG. 2.
Figure 9:
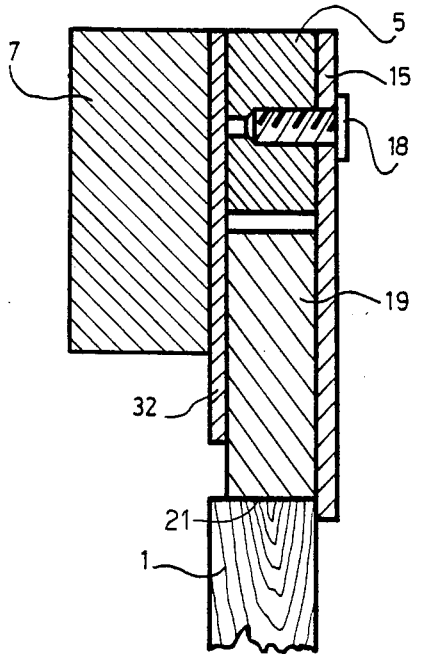
FIG. 9 is a cross-sectional view with portions in elevation for purposes of illustration taken along lines IX—IX of FIG. 1.
Figure 10:
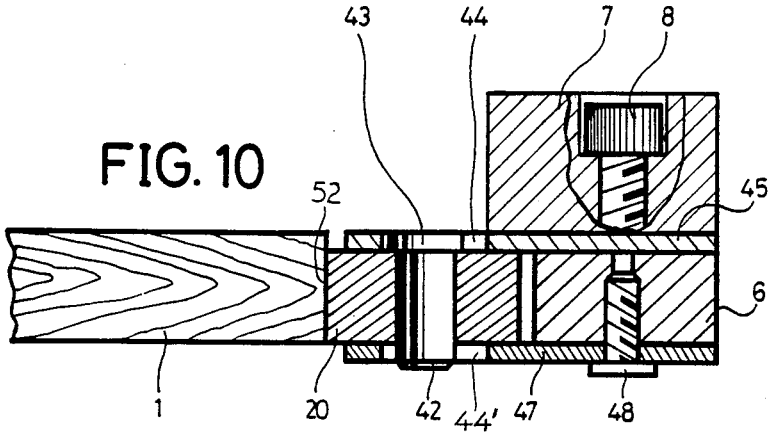
FIG. 10 is a cross-sectional view with portions in elevation for purposes of illustration taken along lines X—X of FIG. 3.
Figure 11:
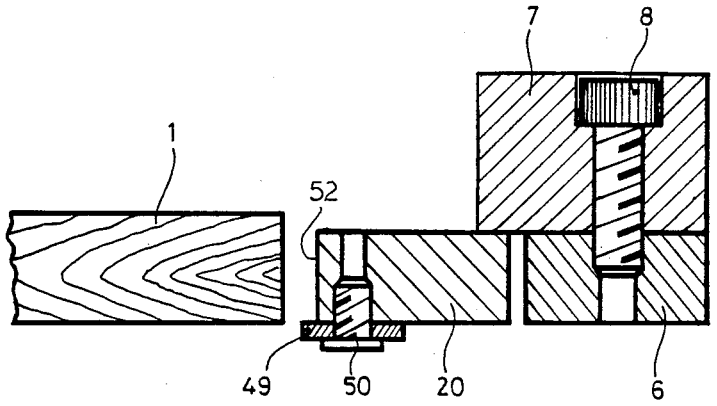
FIG. 11 is a cross-sectional view with portions in elevation for purposes of illustration taken along lines XI—XI of FIG. 3.

The rectangular frame 2 is made up of a longitudinal side member 3, which is a longitudinal stop, a lateral side member 4, which is a lateral stop, a second longitudinal side member 5, which is a longitudinal bar and a second lateral side member 6, which is a lateral bar. These members 3, 4, 5 and 6 are rigidly connected together to form the rectangular frame 2 by a support such as 7 which is illustrated in FIGS. 4–11. The elements or supports 7 is secured against the various side members such as the lateral and longitudinal stops 3 and 4 and the longitudinal lateral bars 5 and 6 by machine screws 8 (FIGS. 5, 8 and 11). However, for purposes of illustration, neither the supports 7 or screws 8 are illustrated in FIG. 1. The frame 2 is provided with two handles 9 and 10 which are secured to one of the lateral side frames such as the bar 6 by screws 11. A centering key 12 is secured to the lateral stop formed by the side member 4 by two screws 16 (see FIG. 4). Before tightening to hold the cutting form within the frame 2, the cutting form is supported in the frame by a plurality of lugs 14 and a guiding plate 15. Each of the lugs 14, as best illustrated in FIG. 5, is secured on the longitudinal stop 3 by a machine screw 16 and maintains the desired position by a centering screw 17. As illustrated, the lug is provided with a recess 75. As best illustrated in FIG. 9, the guiding plate 15 is secured onto a surface of the longitudinal bar 5 by means of screws such as 18.

Figure 2:
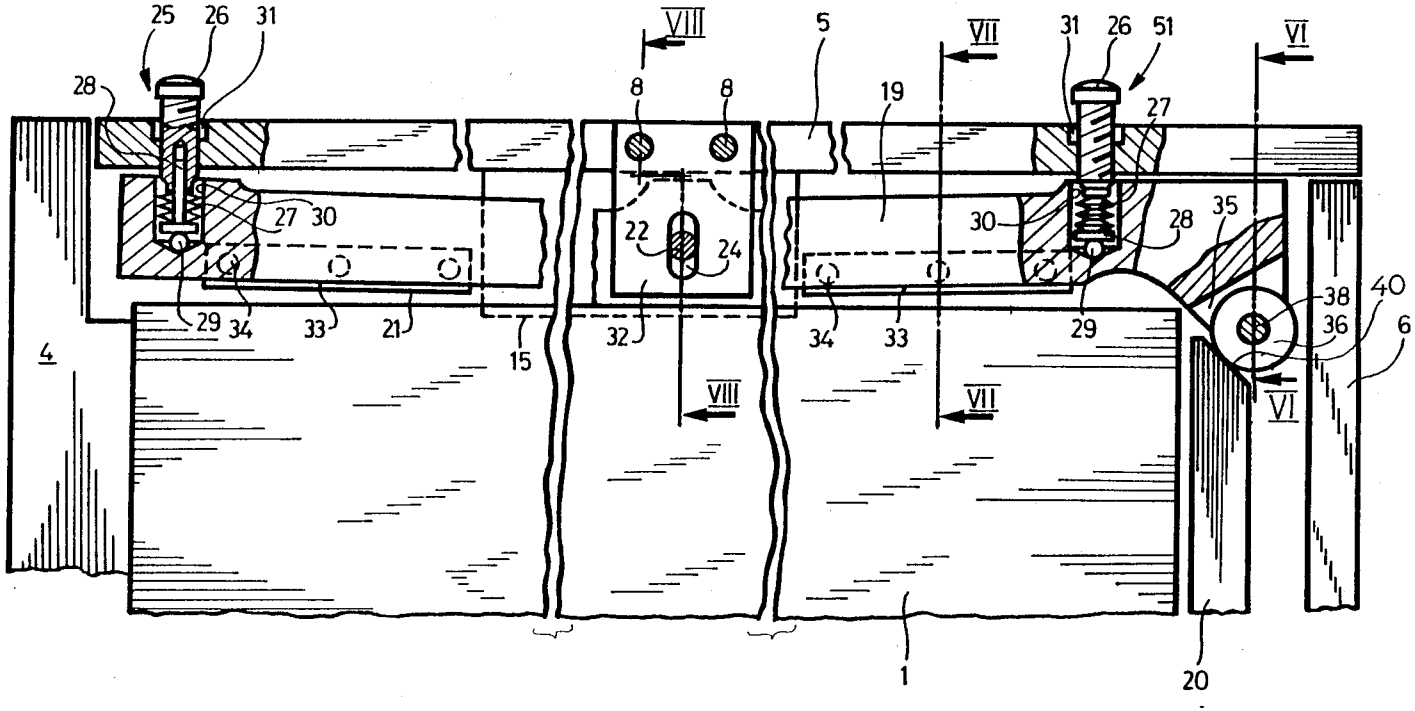
FIG. 2 is an enlarged partial view of a longitudinal side of the frame with portions broken away for purposes of illustration.

As illustrated in FIG. 1, a longitudinal pressing member 19 is mounted for movement on the longitudinal bar 5 and a lateral pressing member 20 is mounted on the lateral side member or bar 6. As best illustrated in FIG. 2, the longitudinal pressing member 19 is in a released position. The longitudinal pressing member 19 as well as the member 20 are both made as a flexible blade having a rectangular cross section (see FIGS. 7 and 11). The pressing member 19 has a pressing surface 21 and the member 20 has a pressing surface 52 when the pressing members 19 and 20 are in a relaxed condition, the pressing surfaces 21 and 52 are not straight. These surfaces have been machined to have a curved configuration which has a profile which suits exactly the deformation curve given by a beam resting on two supports and bearing a uniformly distributed load. While FIG. 2 shows the member 19 in a relaxed condition, FIG. 3 best shows the profile of the surface 52. These supports would be positioned adjacent the ends of the members 19 and 20 and for the member 19 are at the positions of tightening means 25 and 51 which are part of the means for mounting the member 19 on the longitudinal bar 5. The rest of the means for mounting the member include a central axle 22 which has a flange 23 (best illustrated in FIG. 8) which flange 23 is received in an oblong hole or slot 24 in a plate or guide member 32 which is secured on a surface of the bar 5 opposite the surface supporting the plate 15. As also illustrated, the axle 22 extends through the member 19 and is received in an oblong slot 24' of the plate 15. The engagement of the flange 23 in the groove or slot 24 and also the end of the axle 22 in the slot 24' acts to guide the movement of the pressing member 19 as it is shifted inwardly and outwardly from the longitudinal bar 5.

The longitudinal pressing member 19 at each end is provided with tightening means 25 and 51 respectively. Each of the tightening means are illustrated as mechanical tightening means and have a special screw 26 which is threaded into the bar member 5 and has a bore receiving a guide pin 28. Disposed between a head on the guide pin 28 and the end of the screw 26 is a resilient spring means 27 which is illustrated as being composed of a plurality of spring washers. The head of the guide pin 28 engages a ball 29 which is received in the bottom of a bore 30 of the longitudinal pressing member 19. Each of the threaded bores that receive the screw 26 is provided with a countersunk bore or recess 31 so that the head of the screw 26 is completely received within the bar member 5 and this indicates the maximum inward movement of the screw 26. While the tightening means 25 and 51 were described as mechanical tightening means, it should be noted that they can be replaced by either a hydraulic or pneumatic device which utilizes a piston member to replace the screw 26 and to act on the resilient means such as the spring arrangement 27. This piston member could be a pneumatic cylinder acting in the same manner as the screw 26 onto said resilient means.

As best illustrated in FIG. 8, the pressing member 19 is guided to move between the plate 15 and the guide member or plate 32. The plate 32 is mounted on the bar member 5 by a support such as 7 which is held by the screws or machine screws 8. As mentioned hereinabove, the plate 15 also coacts with the lugs 14 to support the cutting form in the frame 2. In addition, the pressing member 19 adjacent each end is provided with plates 33 which are secured to a surface of the pressing member by screws 34 as best illustrated in FIG. 7. These plates 33 will not move underneath the edge of the cutting form 1 until the adjacent tightening means such as 25 or 51 has been actuated to urge the pressing member against the edge of the cutting form 1.

Figure 3:
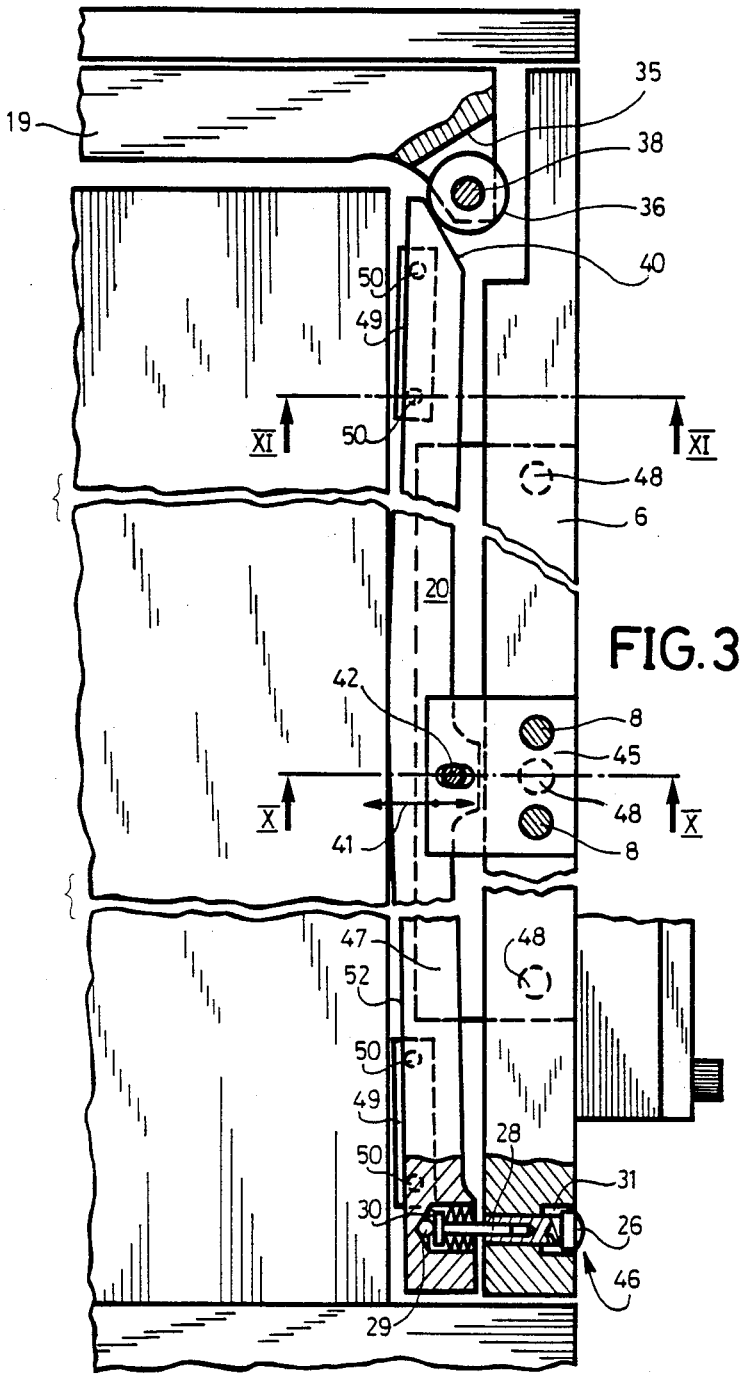
FIG. 3 is an enlarged partial view of a lateral edge of the frame with portions broken away for purposes of illustration.
Figure 4:
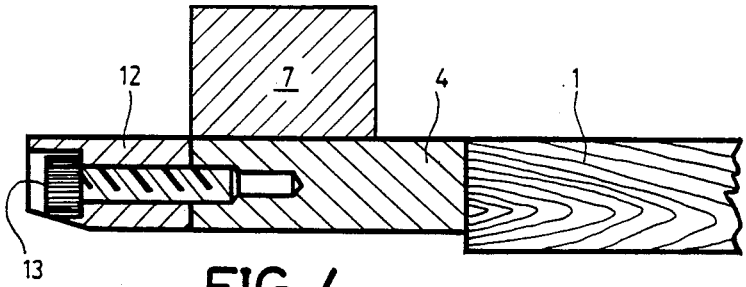
FIG. 4 is a cross-sectional view with portions in elevation for purposes of illustration taken along lines IV—IV of FIG. 1.
Figure 6:
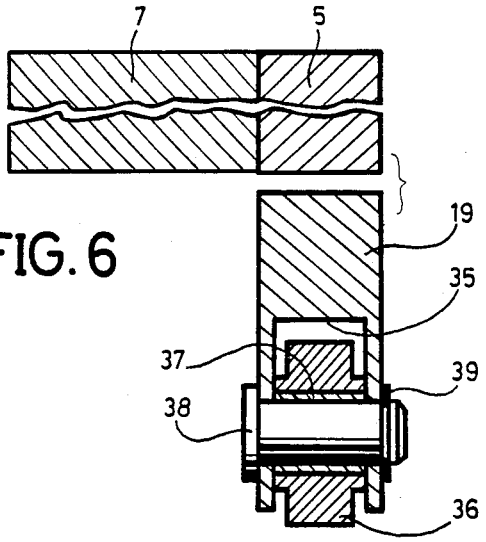
FIG. 6 is a cross-sectional view with portions in elevation for purposes of illustration taken along lines VI—VI of FIG. 2.

As best illustrated in FIG. 2, the longitudinal pressing member 19 at one end is provided with a fork or bifurcated portion 35 which fork receives an axle 38 having a bushing 37 which supports a roller 36 that is mounted for rotation (see FIG. 6). To hold the axle 38 in the fork, a stop or snap ring 39 is utilized. As illustrated in FIGS. 2 and 3, the roller 36 engages a cam surface 40 which is an inclined plane formed on the end of the lateral pressing member 20.

As best illustrated in FIG. 3, the lateral pressing member 20 is mounted so that it can pivot and shift in the direction of the double arrow 41. To accomplish this, a central axle 42 extends through the member 20 and has a head 43 which is received in an oblong opening or slot 44 in a guide member or plate 45. The other end of the axle 42 extends through the opposite surface of the member 20 and is received in an oblong hole or slot 44' which is in a plate 47 (FIG. 10). The plate 47 is mounted on a surface of the lateral bar member 6 by screws 48. It should be noted that the guide member or counterplate 45 is secured on the other surface by the support 7 and that the counterplate 45 and the plate 47 coact to guide the movement of the pressing member 20.

As mentioned hereinabove, one end of the pressing member 20 has the inclined plane forming the cam surface 40 that is engaged by the roller 36 of the longitudinal pressing member 19. The other end of the pressing member 20 is provided with a tightening means 46 which is illustrated in FIG. 3 as a mechanical tightening means having the structure which is the same as the tightening means 25 and 51. The pressing member 20 also has adjacent each end a plate 49 which is secured on one surface by screws 50 (see FIG. 11). Basically, the lateral pressing member 20 is identical to the longitudinal pressing member 19 and has a curved surface 52, which is not straight and has been machined so that it has a curved profile which is exactly the same as the deformation curve of a beam resting on two supports and bearing the regularly distributed load. These supports are located on the axis of the screw 26 for the tightening means 46 and on a touching point for the roller 36 on the cam surface 40. Thus, when pressure is applied by the tightening means 46 and by the roller 36, the pressing member 20 will be bent so that the surface 52 will engage the straight edge surface of the cutting form 1.

The preferred method of utilizing the centering and tightening device of the present invention is as follows. A cutting form is placed in the frame 2 with each of the tightening means 25, 46 and 51 in a released position such as illustrated in FIGS. 2 and 3. In this particular arrangement, the cutting form 1 will be engaged on the plate 15 and the lugs 14. The first step of centering comprises tightening the screw 26 of the tightening means 51 which is adjacent the roller 36. By tightening the screw 26 so that its head is engaged in the recess 31, the pressing member 19 will be pressed into engagement adjacent to the tightening means 51 and due to the coaction of the roller 36 on the cam surface 40, the pressing member 20 will also be engaged with the edge of the cutting form 1 at the same corner. This will cause a diagonally directed force R (see FIG. 1) to be exerted on the corner of the form 1 adjacent the tightening means 51 to urge the cutting form against an inner surface 53 and 54 of the side members 4 and 3 respectively of the frame 2. The centering of the cutting form 1 is then assured. It should be noted that the centering operation is achieved by the screw 26 of the tightening means 51 because any shifting of that end of the longitudinal pressing member 19 will also cause a shifting of the lateral pressing means 20 due to coaction of the roller 36 on the cam surface 40. After tightening the screw 26 of the tightening means 51, the screws 26 of the remaining two tightening means 25 and 46 can also be tightened until they are also at their maximum tightening position which is determined by the head of the screws 26 being engaged in the seat 31. At this moment, the longitudinal and lateral pressing members 19 and 20 will be deformed and apply a regular pressure on the two edges of the cutting form. The exact point of the various tightening means 25, 46 and 51 being adjacent the corners of the frame will prevent any excessive deformation of the frame 2.

The spring arrangement such as the spring washers 27 are designed to apply a force higher than necessary to deform each of the pressing members 19 and 20 and enable them to fit to the eventual side variations of the cutting form 1. The longitudinal lateral pressing members 19 and 20 are arranged so that they float between their guiding members or plates such as 15 and 47 and the plates 32 and 45 respectively. Consequently, they can compensate for any change such as increase or decrease of the size of the cutting form and any change in the size of the form 1 during the cutting operation.

The centering and tightening device of the present invention enables the easy insertion and centering of the cutting form or board as well as securing the board in the desired center position in a frame. Moreover, the centering and tightening device will center the cutting form without creating any deformation of the frame. Therefore, the device simplifies the task of the operation, requires less time to position the cutting form in the frame and therefore improves the production condition of the cutting press.

Although various minor modifications may be suggested by those versed in the art, it should be understood that I wish to embody within the scope of the patent granted hereon, all such modifications as reasonably and properly come within the scope of my contribution to the art.

I claim:

1. A tool support with an arrangement for centering and fixing a tool therein, said tool support having a rectangular frame formed by a pair of longitudinal side members connected to a pair of transverse side members; a pair of pressing members; first means mounting one of the pair of pressing members for movmeent on one of the side members of the frame; and second means mounting the other pressing member of the pair of pressing members for movement on a second side member adjacent the one side member, each of the pressing members being a bendable blade having a pressing surface curved along the length of the member with a profile matching a profile of a beam resting on two supports and bearing a uniformly distributed load, the one pressing member having an end with an inclined plane to form a cam surface, the other pressing member having an end provided with a roller engaging said cam surface, said first means mounting the one pressing member having the cam surface including a central axle on said one pressing member, a guide member on the one side member having a slot extending perpendicular to said one side member slidably receiving said axle, and a tightening means adjacent the end of the one pressing member opposite the cam surface for biasing said end away from the one side member, said second means mounting the other pressing member having a roller adjacent one end including a central axle on said other pressing member, a guide member on the second side member having a slot extending transverse to said second side member slidably receiving said axle, and a pair of tightening means biasing the other pressing member away from the second side member so that actuation of the tightening means adjacent the roller causes both pressing members to exert a diagonally directed force on a tool to urge it into a diagonal direction from the corner adjacent the roller and further actuation of the remaining tightening means urges both pressing members into full engagement with the tool in a centered position in the frame.

2. A tool support according to claim 1, wherein the one side member is a transverse side member, the second side member is a longitudinal side member, the one pressing member is a transverse pressing member and the other pressing member is a longitudinal pressing member.

3. A tool support according to claim 1, wherein each of the pressing members adjacent one side surface are provided with support plates.

4. A tool support according to claim 1, wherein each of the tightening means is a mechanical tightening means comprising a threaded member threaded in a bore of the side member, a guide pin having a head telescopically receiving a spring arrangement and being telescopically received on the threaded member with the spring arrangement arranged between the head and end of the threaded member, and the head of the guide pin engaging a ball disposed in a bore in the pressing member.

* * * * *